United States Patent [19]

Zhao

[11] Patent Number: 5,038,722

[45] Date of Patent: Aug. 13, 1991

[54] FUEL BURNER FOR A BOILER

[75] Inventor: Hui F. Zhao, Pisano, Italy

[73] Assignee: Enel-Ente Nazionale per l'Energia Elettrica, Rome, Italy

[21] Appl. No.: 528,081

[22] Filed: May 24, 1990

[30] Foreign Application Priority Data

Aug. 9, 1989 [IT] Italy ..... 21661 A/89

[51] Int. Cl.[5] ..... F22B 5/00; F23C 1/10

[52] U.S. Cl. ..... 122/13.1; 110/261; 110/262

[58] Field of Search ..... 110/260–265; 122/13.1

[56] References Cited

U.S. PATENT DOCUMENTS

| | | | |
|---|---|---|---|
| 3,822,654 | 7/1974 | Ghelfi | 110/260 |
| 4,270,895 | 6/1981 | Vatsky | 110/262 |
| 4,397,295 | 8/1983 | Bakker | 110/261 |
| 4,412,810 | 11/1983 | Izuha et al. | 110/261 |
| 4,428,309 | 1/1984 | Chang | 110/261 |
| 4,474,120 | 10/1984 | Adrian et al. | 110/261 |
| 4,555,994 | 12/1985 | Voigt et al. | 110/261 |
| 4,566,393 | 1/1986 | Connell et al. | 110/261 |
| 4,928,605 | 5/1990 | Suwa et al. | 110/261 |

*Primary Examiner*—Henry C. Yuen

*Attorney, Agent, or Firm*—Keil & Weinkauf

[57] ABSTRACT

Improvements in a fuel burner for a boiler comprising a first assembly ($S_1$) for delivering into the boiler (3) a fuel stream, a second assembly ($S_2$) for delivering into the boiler a stream of secondary air, a precombustion chamber (6) extended with a certain length ($L_2$) into the combustion chamber (2) in the boiler (3) and a nozzle flameholder (14), opposite the outlet of the fuel stream, which flameholder supplies fluid jets (F) directed against said fluid stream in order to provide a circulation zone in said precombustion chamber (6); a third assembly ($S_3$) is provided for delivering into the boiler a tertiary air stream which laps the inner walls of the precombustion chamber (6) and optionally there is provided a fourth assembly ($S_5$) for delivering a quaternary air stream from outlets (23) of the precombustion chamber (6).

11 Claims, 1 Drawing Sheet

FUEL BURNER FOR A BOILER

Figure 1:
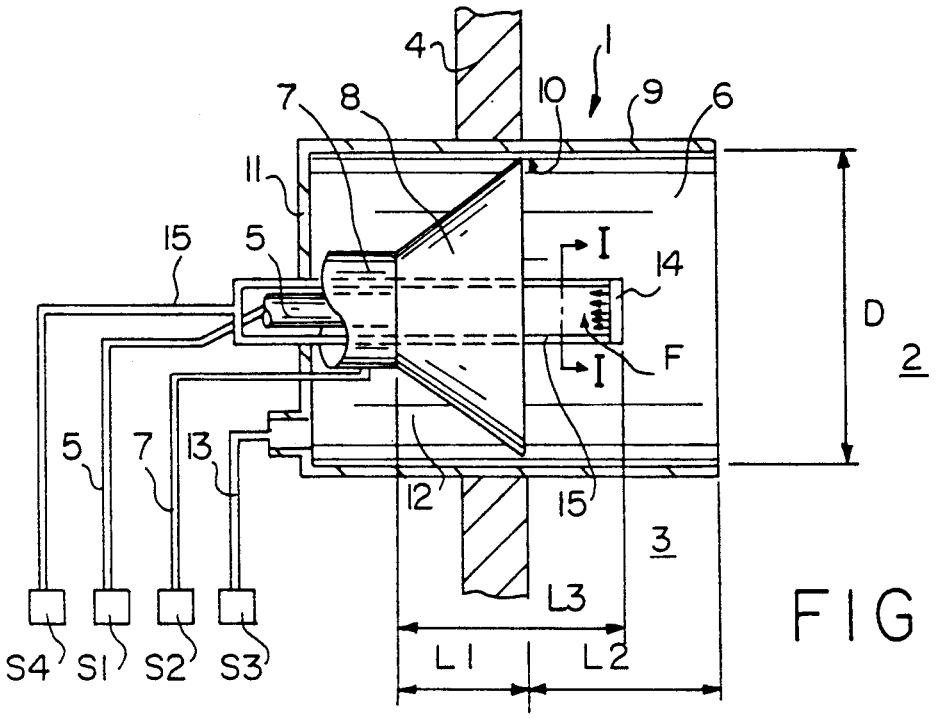

This present invention relates to improvements in a fuel burner for an industrial boiler, particularly to improvements in a burner for low quality and low grade fuels such as coal, lignite, water-coal mixture.

The problem the invention intends to solve is to realize in a simple way the combustion in a boiler and to reduce the production of nitrogen dioxides remarkably.

According to the prior art, strong combustion is provided by recycle zones caused in a combustion or precombustion chamber by means of obstacles located in the turbulent stream, said obstacles being of different shapes, in steps and the like, and causing angular moments in the combustion supporting air, which improves the mixing.

Drawbacks in the prior art are that flame stability and satisfactory limitation of $NO_X$ emissions are not provided for.

In the turbulence burners for low quality atomized solid fuels the centrifugal forces caused by the angular momentum concentrate the solid particles in a thin peripherical zone, whilst the portion of solid particles that succeed in penetrating the recyrcle zone stays in the high temperature zone along a time period which is too short to allow a satisfactory combustion.

Burners are also known which cause in the combustion supporting air a momentum substantially axial with the outlet of said air into the combustion chamber; such burners provide a strong circulation zone and a good combustion also with poor fuels. A drawback of such burners is that they must be placed outside the boiler and may be used only in a precombustion chamber so that it is not possible to use them in a twofold role of burner and preheater; furthermore, they require substantial modifications in the existing boilers.

This present invention, as characterized in the claims, provides a burner which works as preheater too and affords a satisfactory combustion and reduction of $NO_X$.

Such a burner comprises in a known way: a first assembly for delivering into a boiler a stream of liquid fuel or of atomized coal with primary air or of water-coal mixture, said fuels being defined herebelow as—fuel—only; a second assembly for delivering into the boiler a stream of secondary air which supports the combustion; in a new way, the burner comprises a precombustion chamber extended into the boiler combustion chamber and a nozzle flameholder, opposite the outlet of fuel, which supplies fluid jets directed against said fuel stream for causing a circulation zone in said precombustion chamber; a third assembly is also provided for delivering into the precombustion chamber a stream of tertiary air for cooling the walls of the precombustion chamber, amplifying the circulation zone and moving away slags and ashes and also producing a staged combustion; a fourth assembly is provided optionally for delivering into the boiler a stream of quaternary air in order to complete the fuel combustion.

The main advantages afforded by the invented burner are:

i) staged combustion due to the separation of the fuel rich primary zone in the flame core from the tertiary air mixed with fuel, downstream;

ii) the colliding fuel and flameholder fluid jets provide a good circulation zone with strong energy and mass exchange and with excellent flame stability even with low grade fuels.

iii) to provide a burner combined with a preheater; the burner can work independently as a preheater and may be installed in an existing boiler, subject to small modifications thereof;

iv) easy operation and flame stability even if fed by small fractions of the design maximum load;

v) easy construction in the different sizes.

Figure 2:
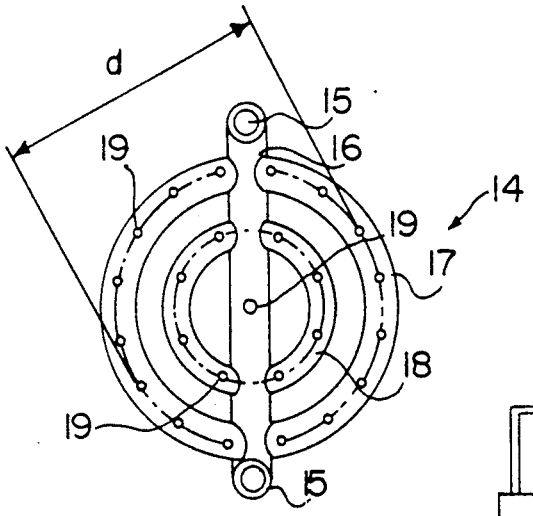
Figure 3:
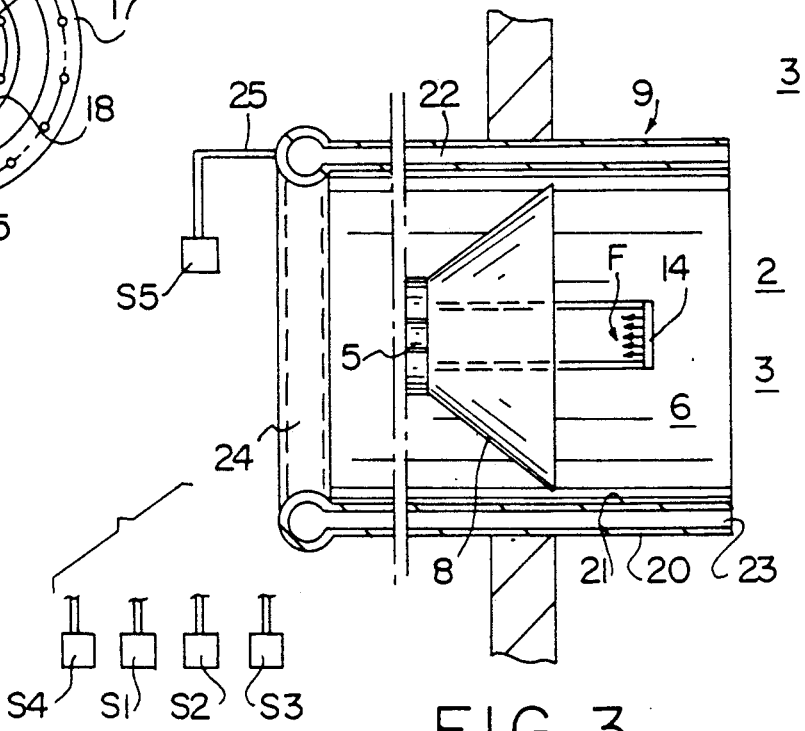

A way of carrying out the invention is described in detail herebelow with reference to the drawing which illustrates a specific embodiment and in which:

FIG. 1 is a diagrammatic side view, partly in section, of a first execution, FIG. 2 is a view along I—I of FIG. 1 and FIG. 3 is a diagrammatic side view, partly in section, of a second execution.

FIG. 1 shows a burner 1 located partly in the combustion chamber 2 in a boiler 3, through a passage in the wall 4 of said boiler; a first assembly comprising a source $S_1$ of compressed primary air and of atomized coal which are delivered by a duct 5 having the outlet in a cylindrical precombustion chamber 6 extended into the combustion chamber 2 of the boiler 3; a second assembly comprising a source $S_2$ of compressed secondary air delivered by a duct 7 having the outlet in said precombustion chamber 6; a first raking wall 8, closed around said two outlets, which extends with a length $L_1$ widening towards the combustion chamber 2; a second cylindrical wall 9 which extends with a length $L_2$ in the combustion chamber 2 to form the precombustion chamber 6 and surrounds the biggest circular base of the first raking wall 8, spaced from said second cyclindrical wall 9 the latter, to define an annular opening 10; a third rear wall 11 which defines a chamber 12 connected by a duct 13 being part of a third assembly comprising a source $S_3$ of compressed tertiary air entering the precombustion chamber 6 through said annular opening 10; a jet flameholder 14, spaced by $L_3$ from said outlet of the fuel delivery duct 5 and having nozzles directed against the fuel stream, which receives compressed combustion supporting air through ducts 15 connected with an air source $S_4$. The air jets ejected from the jet flameholder 14 are shown by arrows F.

FIG. 2 shows in detail the jet flameholder 14 held by the two ducts 15 in a position opposite the exit of duct 5. The ends of said two ducts 15 communicate with a pipe 16 in turn communicating with two circular concentric ducts 17, 18 having equally spaced nozzles 19 on the wall opposite said outlet of duct 5; a further nozzle 19 is in the center of pipe 16.

In the above embodiment, the diameter of the precombustion chamber 6 is $D=500$ mm and the space between the jet flameholder 14 and the outlet of the fuel delivery duct 5 is $L_3=350$ mm. The outlet velocity of secondary air from said duct 7 is $U_2=14$ m/s; the inlet velocity of tertiary air into said precombustion chamber 6 is $U_3=24$ m/s; air outlet velocity from nozzles 19 and secondary air outlet velocity from duct 7 are in the ratio $U_J/U_2=5$. The diameter of the smallest circular base of said raking wall 8 is 130 mm and the diameter of the circle whereon nozzles 19 in the outer duct 17 of flameholder 14 are opened is $d=110$ mm.

FIG. 3 shows an embodiment comprising all the parts comprised in the embodiment illustrated by FIGS. 1 and 2, which parts are now illustrated and numbered in part only, in order not to involve the drawing; in addition, FIG. 3 shows parts required for supplying a quaternary air stream entering the combustion chamber 2 dawnstream with respect to the inlet of the previous three fluids, primary, secondary and tertiary, in order to improve the cooling of the walls of the precombustion chamber 6 and allow the remarkable quantity of axial motion to be maintained for causing in turn a good mixing of air and partly burnt gases in the precombustion chamber 6 as well as to allow the staged combustion is completed in zones alternatively rich and poor in fuel. The precombustion chamber 6 is defined by a cylindric wall 9 made by two walls 20, 21 forming a hollow space 22 affording an annular outlet 23 in the combustion chamber 2. The space between said walls 20, 21 communicates with a toroidal chamber 24 whereto an air stream is delivered from a source of compressed air $S_5$, along a duct 25.

In general, the burner has the following further preferred features:

a) the extension of wall 9 defining the precombustion chamber 6 in the combustion chamber 2 is $L_2<2\cdot D$ (D being the maximum inner width or diameter of precombustion chamber 6).

b) The space between the jet flameholder 14 and the outlet of the fuel delivery duct 5 is $L_3=0.5\div1.0\cdot D$;

c) The diameter of the circle whereon nozzles 19 in the outer circular duct 17 of jet flameholder 14 are opened is $d=0.1\div0.25$ D;

d) The diameter of the holes in the nozzles 19 of jet flameholder 14 is $d_j=2\div4$ mm;

e) The central hole of the jet flameholder 14 may be of 5 mm;

f) The outlet fluid velocity from nozzles 19 in the flameholder 14 and the secondary air outlet velocity from relevant duct 7 are in the ratio $U_j/U_2=2\div6$;

g) The tertiary air inlet velocity ($U_3$) into the precombustion chamber 6 ranges from 20 to 50 m/s.

The number of the annular concentric cyrcular section ducts of the jet flameholder 14 depends upon the width or diameter D of the precombustion chamber 6. For instance, until D is less than 600 mm, the number of said annular ducts 17, 18 is =2.

I claim:

1. A fuel burner and boiler (3) apparatus comprising: a first assembly (S1, 5) connected to the boiler for delivering into the boiler (3) from a fuel delivery duct (5) a liquid fuel or an atomized coal fuel with combustion supporting primary air or a water-coal mixture fuel; a second assembly (S2, 7) connected to the boiler for delivering secondary air in support of the combustion; a precombustion chamber (6) defined by a wall (9) around the fuel burner extended into and opened in the combustion chamber (2) in the boiler, said secondary air being delivered into the precombustion chamber (6) close to the outlet of the fuel delivery duct (5); a third assembly (S3, 10, 12, 13) connected to the boiler for delivering tertiary air into the precombustion chamber (6) downstream from the secondary air outlet, characterized in that a jet flameholder (14) having a nozzle (19), with nozzle outlets being directed towards the outlet of the fuel delivery duct, said flameholder is firmly held in a position opposite to and spaced from the outlet of said fuel delivery duct (5) and in said precombustion chamber (6), being connected to an assembly (S4, 15) which provides compressed fluid in order to eject fluid jets (F) against the stream of said fuel from the fuel delivery duct and provides a zone in said precombustion chamber (6) between said flameholder (14) and said outlet of said fuel delivery duct (5) wherein the fluid and fuel respectively ejected from said flameholder (14) and delivery duct (5) meet in opposition and circulation.

2. Apparatus according to claim 1 characterized in that the precombustion chamber (6) comprises a raking wall (8) which is closed around the outlets of the fuel and of the secondary air, extends widening towards the combustion chamber (2) and has the biggest base close to and spaced from said wall (9) of the precombustion chamber (6) to define an annular opening (10) for passing the tertiary air into the precombustion chamber (6).

3. Apparatus according to claim 1 characterized in that it comprises a fourth assembly ($S_5$, 22, 23, 24) for delivering a quaternary air stream in the combustion chamber (2).

4. Apparatus according to claim 3 characterized in that the wall (9) of said precombustion chamber (6) comprises passages (22) to lead the quaternary air from said assembly ($S_5$, 22, 23, 24) to the combustion chamber (2).

5. Apparatus according to claim 4 characterized in that said wall (9) is a cylindric wall made by two spaced elements (20, 21) which define said passages (22) as an annular hollow space (22) having the outlet (23) in the combustion chamber (2).

6. Apparatus according to claim 1 characterized in that said jet flameholder (14) comprises at least one circular duct (18) having equally spaced nozzles (19) on the wall facing the outlet of the fuel delivery duct (5).

7. Apparatus according to claim 6 characterized in that said jet flameholder (14) comprises two circular concentric ducts (17, 18) until the maximum width (D) of the precombustion chamber (6) is less than 600 mm.

8. Apparatus according to claim 1, which further comprises an extension ($L_2$) of the precombustion chamber (6) in the combustion chamber (2) which is less than twice the maximum width (D) of the precombustion chamber (6).

9. Apparatus according to claim 1 characterized in that the space between the jet flameholder (14) and the outlet of the fuel delivery duct (5) ranges from 0.5 to 1.0 time the maximum width (D) of the precombustion chamber (6) and the diameter of the circle whereon the nozzles (19) in the outer circular duct (17) in the jet flameholder (14) are opened ranges from 0.1 to 0.25 times the maximum width (D) of the precombustion chamber (6).

10. Apparatus according to claim 1 characterized in that the outlet fluid velocity ($U_j$) from the nozzles (19) in the jet flameholder (14) and the outlet secondary air velocity ($U_2$) from the secondary air duct (7) are in the ratio ranging from 2 to 6.

11. Apparatus according to claim 1 characterized in that the inlet tertiary air velocity ($U_3$) into the precombustion chamber (6) ranges from 20 to 50 m/s.

* * * * *